United States Patent [19]

Fischer

[11] 4,193,147

[45] Mar. 18, 1980

[54] CANTILEVERED LIFTING AND TRANSPORTING DEVICE

[76] Inventor: Edwin L. Fischer, 22035 W. Carbon Mesa Rd., Malibu, Calif. 90265

[21] Appl. No.: 922,940

[22] Filed: Jul. 10, 1978

[51] Int. Cl.[2] ..... A61G 5/00

[52] U.S. Cl. ..... 5/81 R; 5/86; 297/DIG. 4

[58] Field of Search ..... 5/81 R, 86, 87, 89; 297/DIG. 4

[56] References Cited

U.S. PATENT DOCUMENTS

| | | | |
|---|---|---|---|
| 2,891,256 | 6/1959 | Scully | 5/87 |
| 3,147,039 | 9/1964 | Smith et al. | 5/86 |
| 3,259,922 | 7/1966 | Fischer | 5/86 |
| 3,618,968 | 11/1971 | Greer | 297/DIG. 4 |
| 3,767,260 | 10/1973 | Limpach | 297/DIG. 4 |

*Primary Examiner*—Casmir A. Nunberg
*Attorney, Agent, or Firm*—Jessup & Beecher

[57] ABSTRACT

A cantilevered lifting and transporting device which may be automatically or manually converted from a chair to a stretcher or vice versa. The lifting and transporting device is comprised of a U-shaped base having a pair of vertical telescoping supports on which a horizontal frame is mounted. The frame has two horizontal members or rods acting as fulcrums for supporting a rotatable back rest and leg rest which also provide support for a seat. The device is raised and lowered by a hand-cranked screw and nut combination in one of the vertical supports. An articulated connection between the rotatable back rest and the rotatable leg rest permits rotation of these parts from substantially vertical positions to horizontal positions. Attached to the rotatable back rest is an indexing plate which has a plurality of holes cooperating with a spring-biased plunger to lock the device in a variety of positions from upright to flat or in between. An automatic mode is provided by an extension on the indexing plate connected to a fixed length connecting rod pivotally secured to the base frame. This connecting rod causes the back rest and leg rest to automatically rotate from the upright or chair position to a horizontal position or stretcher when the device is raised to its highest position. An outrigger and sling is provided, telescoping into one of the vertical supports for lifting a patientfrom the chair. The outrigger is rotatable from the stored position beside the chair to a position over the chair for use in lifting a patient. Arm rests and adjustable foot rests are also provided.

17 Claims, 23 Drawing Figures

CANTILEVERED LIFTING AND TRANSPORTING DEVICE

BACKGROUND OF THE INVENTION

This invention relates generally to lifting and transporting devices and more particularly relates to a lifting and transporting device which is adjustably convertible from a chair to a stretcher.

There are numerous lifting and transporting devices known for either lifting patients out of wheelchairs or from beds, and among these devices are several devices patented by the inventor of the device disclosed herein. In U.S. Pat. Nos. 2,908,916, issued Oct. 20, 1959 and 3,259,922, issued July 12, 1966, there are disclosed devices designed to lift patients to and from beds and to and from operating, X-ray, cystoscopic or surgery tables with the minimum amount of disturbance to the patient. The latter device is particularly effective because it can be readily raised and lowered. However, the device only permits transporting the patient in the prone position. It would be desirable if a patient could be transferred to the device and transported in a vertical position, such as wheelchair which is used on many occasions.

Another patent to the inventor of the device disclosed herein U.S. Pat. No. 3,137,011, issued June 16, 1964, also discloses a system for lifting a person in and out of a wheelchair for various purposes. Again, while this solves many problems in lifting and transporting patients, it is not particularly effective in use with the lifting and transporting devices of the patents referred to above. Thus, many of the devices describe lifting and transporting apparatus which permit transferring the patient either in a wheelchair or on an adjustable stretcher or bed. However, none of the devices permits converting the stretcher to a chair or vice versa for removal and transporting of patients.

SUMMARY OF THE INVENTION

The purpose of the present invention is to provide a lifting and transporting apparatus which can provide all the functions of prior devices and also be convertible from a chair to a bed, either automatically or manually.

The present invention is comprised of a U-shaped base frame having casters for portability on which a pair of tubular telescoping vertical upright members is attached. Attached to the telescoping members is a horizontal frame which may form the seat of the chair position of the device. Horizontal rods or bars on the horizontal frame beneath the seat rotatably support the back rest and leg rest which are linked together by articulated connecting arms. An indexing plate on the back rest cooperates with a spring-loaded plunger to lock the device in a variety of positions from upright to flat. Thus, by simultaneously rotating the back rest and foot rest to either vertical or horizontal positions, or several positions in between, the device can be locked in that position by engaging the indexing plate with a spring-loaded plunger engaging a selected hole in the indexing plate.

The seat or stretcher is raised and lowered by a Saginaw (ball bearing) screw combined with a hand crank on one of the telescoping upright tubular members. This permits raising the seat or horizontal frame of the device to the level of a bed for transferring a patient to the transporting device. The transfer can be more easily made with the device converted to the stretcher position. The base frame has one side completely open so that the cantilevered horizontal frame mounted on the tubular upright members can extend over the side of a hospital bed to permit easy transfer of a patient from the bed to the transporting device. This reduces the chances of the device moving during transfer. In some prior art devices the device could not extend over the bed creating the danger of the device moving and the patient falling.

An extension on the indexing plate connected to a fixed length connecting rod secured to the base permits the device to be operated in an automatic mode. That is, with the plunger disengaged from the indexing plate and the crank operated to lower or raise the device, the fixed length connecting rod simultaneously rotates the back rest and the leg rest from an upright position to a horizontal or flat position. Thus, as the device is raised, the connecting rod rotates the back rest to a horizontal position permitting the device to be in the form of a stretcher at its highest level. When the device is lowered in the automatic mode, the connecting rod causes the back rest to rotate slowly to a vertical position, converting the device automatically to a chair at its lowest level.

The device may be converted for manual use by releasing the fixed length of the connecting rod. This is provided for by making the connecting rod out of the telescoping tubes with a spring-loaded plunger locking the tubes at a predetermined length for automatic operation and releasing them for telescopic operation during manual mode. With the plunger disengaged, the back rest may rotate from a horizontal to a vertical position at any level and may be locked by a plunger engaging the holes in the indexing plate.

The simultaneous operation of the back rest and leg rest is performed by an articulated connecting arm rotatably secured to vertical arms secured to the foot rest and the back rest respectively. The indexing plate forms the vertical arm for attachment to the back rest while a horizontal rod rotatably connects to a substantially vertical arm on the foot rest. This mechanism forms an articulated rotatable parallelogram for rotating the device from a flat position to an upright position.

Included in the device is an outrigger for attaching a sling for lifting a patient from the stretcher or chair to permit using a bedpan or other treatment. The outrigger is comprised of a vertical column telescoping or sliding inside one of the vertical telescoping supports. The outrigger has a vertical tubular member and a horizontal member which can be rotated from a rearward facing position to a forward facing position when in use. Attached to the horizontal arm or member of the outrigger is a second rotatable arm which may be rotated from a horizontal position when in use over the seat to a vertical position when the entire outrigger assembly or lifting mechanism may be removed by simply sliding the vertical column out of the telescoping vertical support tube.

Arm rests are provided which removably fit sockets in the horizontal frame for the seat. The arm rests on the side opposite the telescoping tubes are provided with a folding mechanism to permit the arm rests to fold flat to the level of the seat during transfer of a patient to the bed or chair. The folding arm rest has two rods rotatably supported on the horizontal seat frame. A telescoping sleeve having a lock screw secures one of the rods to the seat frame to hold the arm rest in a fixed upright position while permitting the arm to fold to a stored position for transferring of the patient.

It is one object of the present invention to provide a lifting and transporting device convertible from a stretcher to a chair.

Another object of the present invention is to provide a lifting and transporting device which is cantilevered to permit the device to fit over the edge of a bed or other horizontal surface.

Still another object of the present invention is to provide a lifting and transporting device which has an automatic mode for converting the device from a chair to a stretcher.

Still another object of the present invention is to provide a lifting and transporting device having means for manually converting the device from a chair to a stretcher.

Still another object of the present invention is to provide a lifting and transporting device having a crank system for lowering and raising the device.

Yet another object of the present invention is to have a lifting and transporting device which has a lifting mechanism for lifting a patient from the chair or stretcher.

Yet another object of the present invention is to provide a lifting and transporting device having a lifting mechanism which may be swung away to a stored position when not in use.

Still another object of the present invention is to have a lifting and transporting device which has a lifting mechanism which may be completely removed, if desired.

Yet another object of the present invention is to provide a lifting and transporting device having rotatable back rest and leg rest interconnected for simultaneous rotation.

Another object of the present invention is to provide a lifting and transporting mechanism with simultaneously rotating back rest and leg rest and an indexing device for locking the mechanism in a variety of positions.

Other objects, advantages and novel features of the invention become apparent from the following detailed description of the invention when considered in conjunction with the accompanying drawings wherein like reference numbers identify like parts throughout.

DETAILED DESCRIPTION OF THE PREFERRED EMBODIMENT

Figure 1:
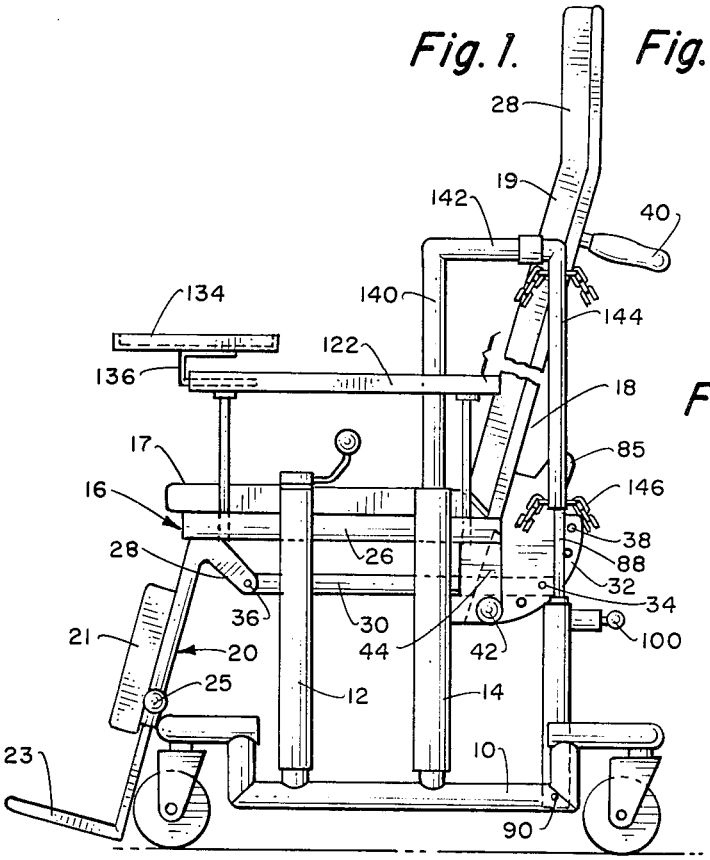
FIG. 1 is a side elevation of the lifting and transporting device according to the invention.
Figure 3:
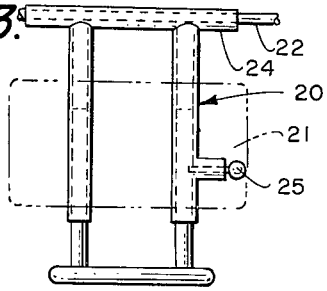
FIG. 3 is a detail view of the leg rest of the lifting and transporting device.

Referring now to FIG. 1, there is shown a lifting and transporting device in the upright or chair position. The device is comprised of a base frame 10 having a pair of upright or vertical supports 13 and 15 engaging telescoping members 12 and 14 attached to a horizontal frame 16, forming the seat of the chair in the chair position. Rotatably attached to the opposite sides of the frame 16 is a back rest 18 and a foot rest 20. The foot rest 20 is rotatably mounted on a rod 22 acting as a fulcrum which forms part of the horizontal frame 16 with the tubular portion 24 of the foot rest 20 fitting over the rod or bar 22.

The back rest assembly 18 has a similar construction mounted on a second horizontal rod similar to that on which the foot rest rotates.

Figure 13:
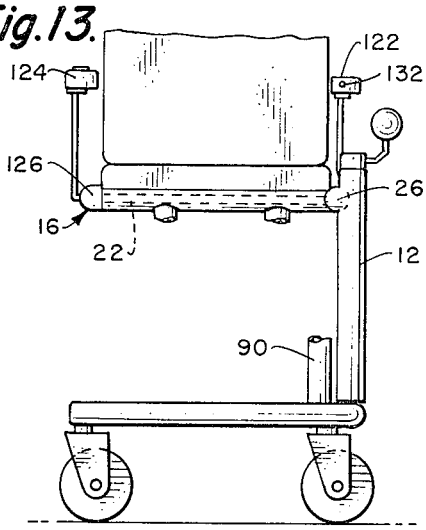
FIG. 13 is a partial front elevation of the lifting and transporting device.

The vertical supports 12 and 14 are comprised of telescoping tubes with the tube 26 of the horizontal frame 16 securely attached by welding or any other suitable means, as can be seen more clearly in FIG 13. Thus, the seat or stretcher is of a cantilevered construction with no obstructions on the open side of the base frame permitting the seat or stretcher to slide over an adjacent surface for transfer as will be described in greater detail hereinafter.

Simultaneously, movement of the foot rest assembly and back rest assembly 18 is achieved through an articulated parallelogram formed by a vertical bar 28 connected to the foot rest 20, a horizontal bar 30 pivotally connected at 36 to bar 28 and an indexing plate 32 pivotally connected to the horizontal bar 30 at 34 and to the back rest 18. The tube 26 of the horizontal seat frame 16 forms a stationary side of the articulated parallelogram. Thus, as the back rest 18 rotates to a horizontal position, the foot rest likewise simultaneously rotates to a horizontal position because of the rotating linkage 30 pivotally connected at 36.

Figure 2:
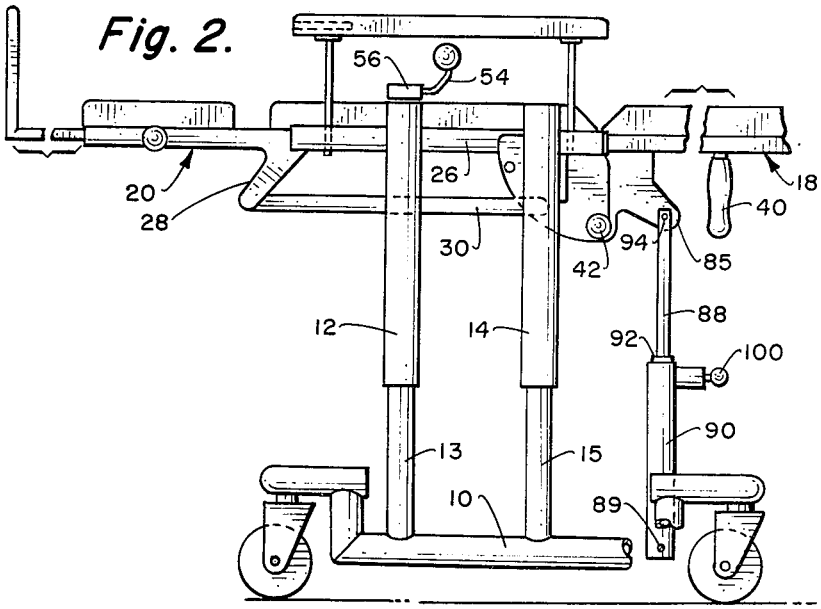
FIG. 2 is a partial side elevation of the device of FIG. 1 in the stretcher position.
Figure 8:
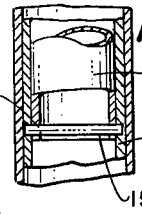
FIG. 8 is a partial cross-sectional view showing the positioning details of the lifting mechanism.
Figure 9:
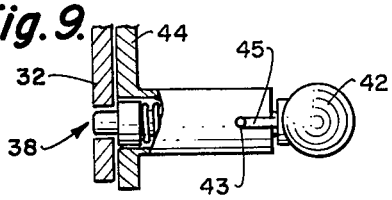
FIG. 9 is a view of the spring-loaded plunger mechanism partly in cross-section.

The lifting and transporting device is manually converted from a chair to a stretcher by a single gripping handle 40 (mounted only on the left side so as to avoid any obstructions on the right side) and rotating the seat back to a horizontal position which simultaneously rotates the foot rest to a horizontal position as illustrated in FIG. 2. The lifting and transporting device can be locked in position by means of a plunger 42 mounted on a bracket 44 attached to the horizontal frame tube 26 and vertical support 14. The plunger 42 is illustrated in greater detail in FIG. 9 which illustrates the plunger engaged in one of the indexing holes 38 of the indexing plate 32. Thus, the chair can be locked in a variety of positions by engaging the plunger 42 in one of the indexing holes 38 at the appropriate preselected position. The plunger 42 may be retained in a retracted position by pulling the pin 43 out of the slot 45 with a slight turning motion. This maintains the plunger disengaged from the indexing holes 38, allowing the indexing plate, back rest and foot rest to swing freely. Once the lifting and transporting device is adjusted to a particular desired position, the plunger may be engaged simply by turning and re-engaging the pin 43 in the slot 45 locking the transporting device in the position selected. This is the manual mode of operating for converting from the upright position of a chair to the horizotal position of a stretcher.

The chair or stretcher can be raised and lowered through a screw and nut combination forming a hand crank. The raising and lowering device is comprised of a Saginaw ball bearing nut 46 which is threaded into an anchor nut 48 locked to the inner tube 13 by a set screw 50. Passing through the nut 46 is a cooperating Saginaw screw 52 secured by a nut 58 to a hand crank comprised of handle 54 and cap 56. A stop collar 60 is provided on the lower end of the Saginaw screw 52. A load-carrying collar 62 is mounted above the nut 46 and is locked to the screw 52 by a set screw 64. A series of bronze washers 66 and 68 are mounted above the collar 62 along with a steel washer 70. The steel washer 70 has a controlled diameter and surface finish to obtain the desired hold-back friction when lowering the seat/stretcher or holding it stationary. The washers 66, 68, 70 are loosely fitted on the unthreaded portion of the screw 52.

Figure 5:
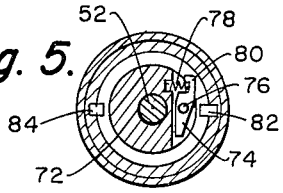
FIG. 5 is a view taken along line 5—5 of FIG. 4 showing the brake mechanism for the lifting and lowering mechanism.
Figure 4:
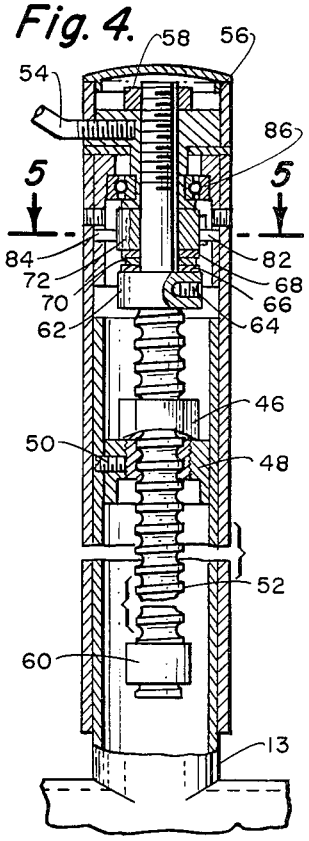
FIG. 4 is an elevational view partly in cross-section showing the raising and lowering mechanism of the device.

A brake cylinder 72 is rotatably mounted on the unthreaded portion of the screw 52, and has a pawl 74 pivoted on a pin 76 mounted in a segment thereof (see FIG. 5). A spring 78 biases the pawl 74 in an outward direction to lock the brake cylinder 72 by engaging the end 80 of the pawl 74 with one or the other of pins 82 or 84 when the screw, frame and seat/stretcher are being lowered or are stationary. When the screw, frame and seat/stretcher are being raised, the pawl 74 overrides the pins 82 and 84 to eliminate any braking action and to permit the ball bearing 86 to provide the minimum of friction during the raising cycle. Since there is substantially no friction introduced by the ball bearing 86, no difficulty is encountered during the raising operation. This lifting mechanism and brake feature is described and claimed in U.S. Pat. No. 3,137,011 to the same inventor as the device disclosed herein and referred to hereinabove.

The lifting and transporting device also incorporates an automatic mode in which raising and lowering the device automatically converts it from a chair to a stretcher and vice versa. This is accomplished by means of a connecting rod 88 pivotally attached to an extension 85 on indexing plate 32. The extension 85 could be an independent bracket attached to the back rest 18, if desired, but is preferably an extension on the indexing plate 32. The connecting rod 88 is secured to the base frame 10 by means of a tube 90 pivotally attached to base frame 10. The tube 90 pivots on a fulcrum provided by pin 89 secured to the base frame 10. An intermediate telescoping tube 92 is provided for a manual operation which will be described in greater detail hereinafter.

In the automatic mode the plunger 42 is disengaged from the indexing plate 32 permitting the indexing plate to freely swing as the back rest and foot rest are rotated from a horizontal to a vertical position. However, the motion of the back rest 18 and foot rest assembly 20 is restrained by the fixed length of the connecting rod 88 attached to the extension 85. Thus, the back rest 18 and foot rest 20 can only rotate in conjunction with rotation of the pivot point 94 which is effected by raising the lifting and transporting device as illustrated in FIG. 2. Thus, as crank handle 54 is operated to raise the lifting and transporting device, the fixed length of connecting rod 88 causes the back rest 18 to rotate from an upright position as shown in FIG. 1 to a horizontal position as shown in FIG. 2. It should be noted that plunger 42 should be retained in a disengaged position from indexing holes 38 in index plate 32 to permit automatic operation.

Figure 12:
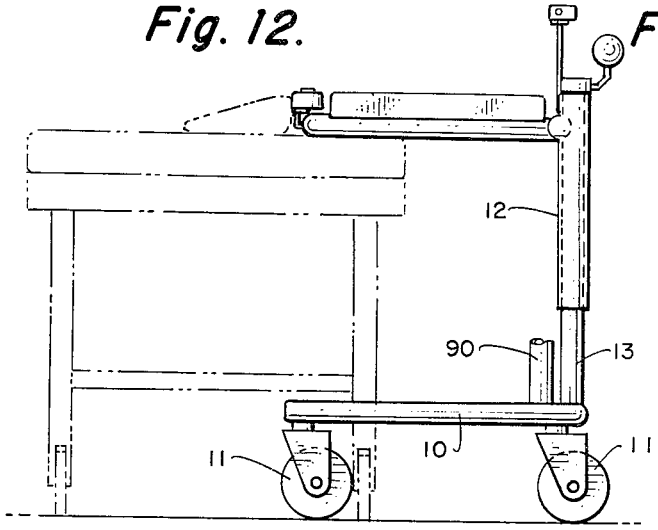
FIG. 12 illustrates the device in the stretcher position and its cantilevered construction for engagement with a bed or horizontal plane surface.

The automatic operation provides an advantage in that a patient can be readily transferred to the lifting and transporting device and then raised to a sitting position merely by lowering the device. The transfer is accomplished as illustrated in FIG. 12. With the lifting and transporting device in its fully raised or highest position, as illustrated in FIG. 2, it may, because of its cantilevered construction, be slid over the edge of an operating table or bed by means of casters or rollers 11 and a patient lifted or slid onto the transporting device. The device may now be moved away from the bed and by operating the crank 54 the stretcher may be lowered automatically converting the stretcher into a seat (as illustrated in FIG. 1) by means of fixed length connecting rod 88 pivoting the back rest through the extension 85 and connected at pivot point 94. The plunger 42 usually will remain disengaged but may be engaged in any one of the indexing holes 38 to lock the lifting and transporting device in a selected position, if desired.

Figure 14:
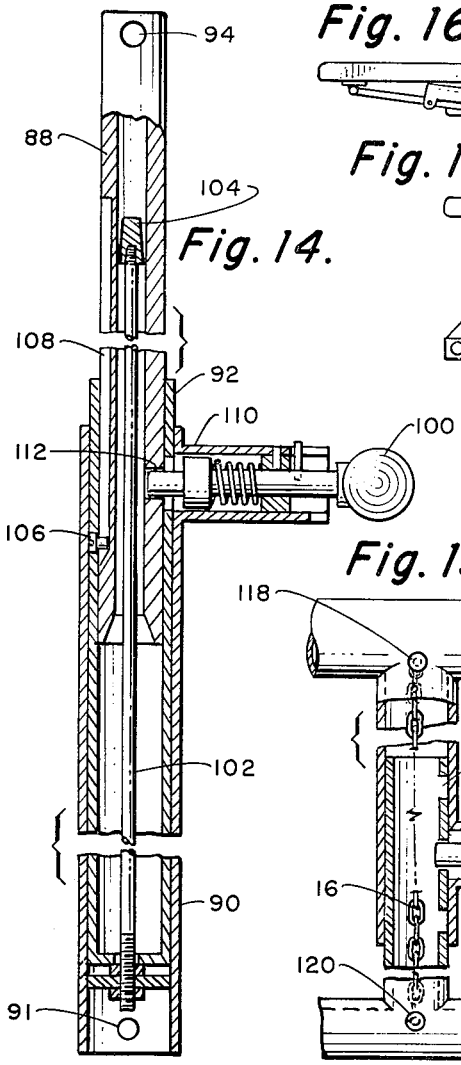
FIG. 14 is a detail view of the connecting rod partially in cross-section.

In order to permit manual operation of the lifting and transporting device, the connecting rod 88 must be disconnected from the pivot point 94 or in some way released to permit its length to vary. Thus, when operating in the manual mode, rods 88 and 92 may slidingly telescope into tube 90, permitting the indexing plate 32 and the back rest and foot rest to freely swing without restraint. This is accomplished through a plunger mechanism 100 mounted on the tube 90 shown in greater detail in FIG. 14. The plunger mechanism is illustrated engaging the connecting rod 88 holding it to the fixed length used during the automatic mode. In the manual mode the plunger 100 is withdrawn and rotated slightly to retain it in the disengaged or withdrawn position. When in this position the connecting rod 88 and tube 92 may telescopically slide within each other and within the tube 90 attached to the base frame 10. The intermediate tubular member 92 merely serves the purpose of providing an extension and keeping the connecting rod 88 from becoming disengaged.

Figure 17C:
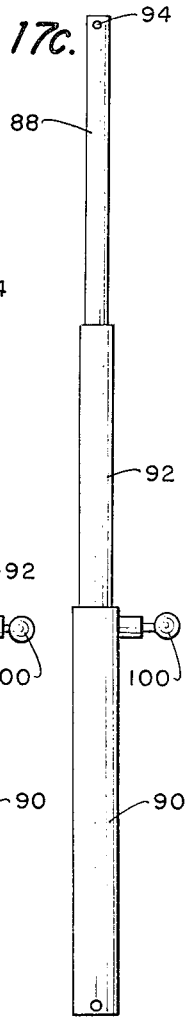
FIGS. 17A through 17C illustrate the conversion of the connecting rod from a fixed length to a telescoping length.
Figure 17B:
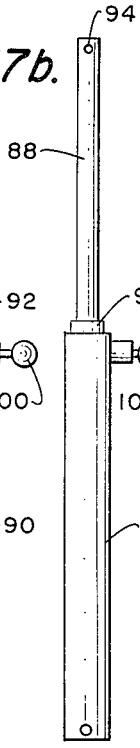
Figure 17A:
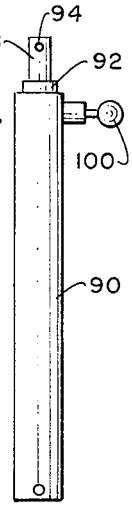

A rod 102 having a stop 104 on one end acts as a retainer for the intermediate tube 92 while a pin 106 riding in a slot 108 in the connecting rod 88 acts as a retainer for it. A hole 110 in the intermediate tube permits the plunger 100 to pass directly into the hole 112 in the connecting rod 88. When retracted, the plunger 100 permits free travel of the telescoping tubes 88 and 92 in the tube 90, as illustrated in FIGS. 17A, B and C. In order to provide free movement when changing from a seat position to a stretcher position the tube 90 is pivotally mounted on the base 10 in the fully retracted position, which is its approximate position with the device in the stretcher mode and the crank 54 at its lowest position. In FIG. 17B the plunger 100 would be engaged through the intermediate tube 92 into the connecting rod 88 providing a fixed length for automatic operation of the lifting and transporting device. In FIG. 17C the telescoping assembly is shown with connecting rod 88 and intermediate tube 92 fully extended and plunger 100 in the retracted position. This would be equivalent to the device in the chair mode and at its highest position of the crank 54.

Figure 15:
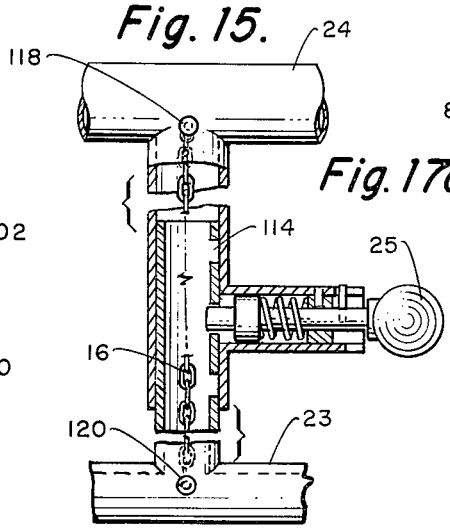
FIG 15 is a partial cross-section illustrating the adjustable operation of the foot rest.

The leg rest assembly 20 is provided with a suitable pad 21 and a foot rest 23 which is adjustable by means of another spring-biased plunger 25 illustrated in detail in FIG. 15. The foot rest 23 may be manually extended or retracted by retracting the plunger 25 and lowering or raising the foot rest and then reinserting the plunger 25 in a selected hole 114 for the desired adjustment. A chain 116 secured by a pin 118 in tube 24 at one end and a second pin 120 in the foot rest 23 provides a limit stop to retain the foot rest. Each of the retractable plungers 25, 42 and 100 are of the usual spring-biased type having detent means for maintaining them in their retracted position.

Figure 16B:
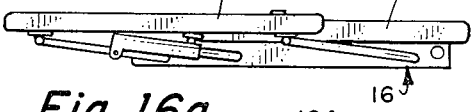
FIGS. 16A and 16B illustrate the operation of the foldable arm rest.
Figure 16A:
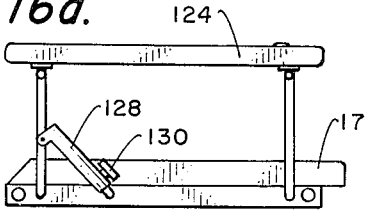

One arm rest adjacent to the crank is fitted into the tube 26 forming a portion of the horizontal seat frame. A second arm rest 124 is pivotally or swivelly mounted in the tubular member 126 on the opposite side of the horizontal seat frame assembly 16. The latter arm rest 24 is constructed to be folded flat parallel with the seat cushion 17 for transferring a patient to the lifting and transporting device. This function is illustrated in FIGS. 16A and 16B. A telescoping connection 128 operated by a thumb or locking screw 130 permits the arm rest to be folded flush with the seat cushion 17 when transferring a patient. After a patient is transferred to the lifting and transporting device, the arm rest 124 may be rotated to an upright position and the telescoping tube 128 locked by the thumb screw 130. A hole in the arm rest 122 permits installation of a tray 134 as shown in FIG. 1 with a bar 136 fitting into the hole 132 (FIG. 13) in the arm rest 122.

Figure 10A:
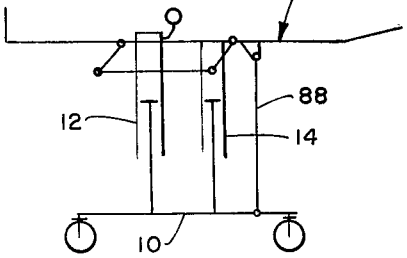
FIGS. 10A through 10C is a semi-schematic diagram showing the operation of the transporting and lifting device.
Figure 10B:
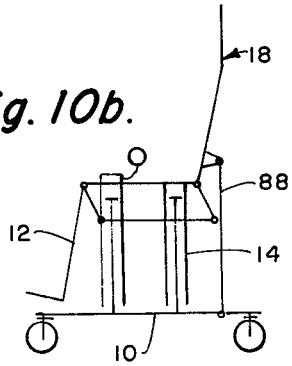
Figure 10C:
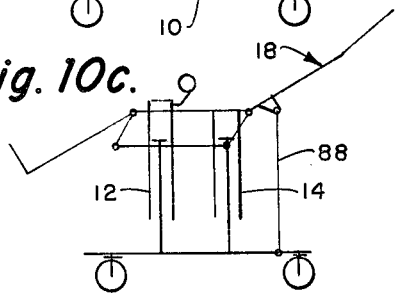
Figure 11A:
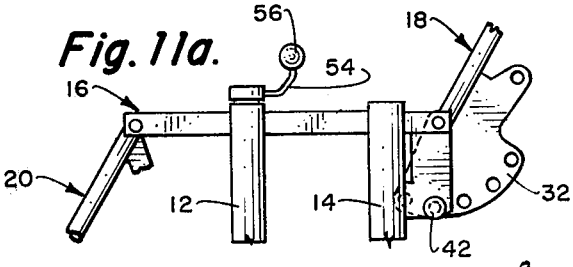
FIGS. 11A and 11B illustrate the manual and automatic mode of operation of the device respectively.
Figure 11B:
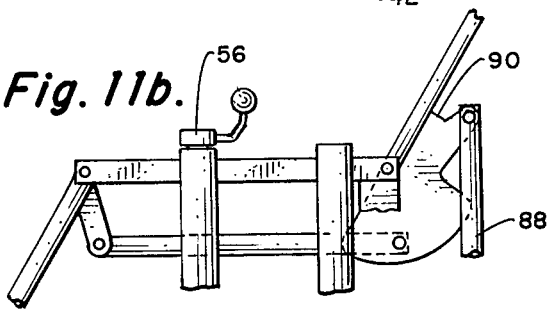

The operation of the device in the automatic mode and conversion to the manual mode is illustrated in FIGS. 10 and 11. In FIG. 10A with the lifting device raised to its highest position, the fixed length connecting rod 88 rotates the device to a horizontal or flat position forming a stretcher. In FIG. 10B with the crank lowered to its lowest point, the fixed length connecting rod 88 converts it to a chair. In FIG. 10C the chair is schematically illustrated in an intermediate position. FIG. 11A illustrates the manual mode of operation with the connecting rod disconnected from the indexing plate 32. Thus, the device must be manually rotated from upright to flat position by disengaging the plunger 42. In FIG. 11B the device is illustrated in a solely automatic mode with the connecting rod 88 attached to the extension 90, which may or may not be a part of the indexing plate 32 for automatically rotating the device from an upright to a prone position when the crank 56 is operated raising the device.

Figure 7:
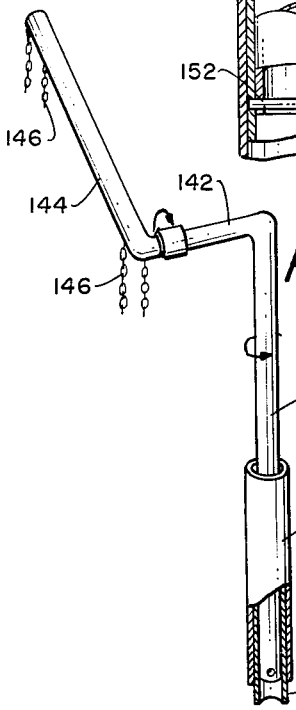
FIG. 7 is a detail view of the lifting mechanism partly in cross-section.
Figure 6:
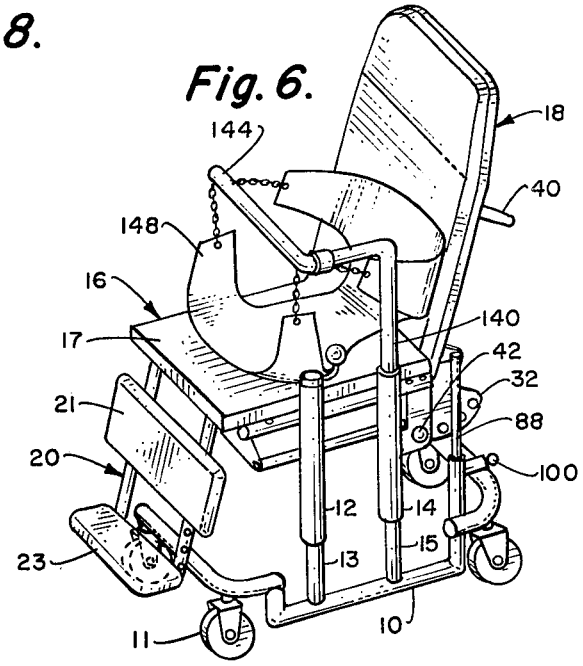
FIG 6 is a perspective view of the lifting and transporting device with the outrigger lifting mechanism installed and in use.

A lifting mechanism is provided to place a patient on a bedpan when lifting and transporting device is in the chair or the stretcher position. The lifting mechanism is illustrated in FIGS. 6 and 7 and is comprised of a vertical column or tube 140 which telescopes into inner tube 15 of one of the upright supports. The vertical column or tube 140 has a horizontal section 142 to which a rotatable or swivelly mounted outrigger tube 144 is mounted. The outrigger 144 may be swivelled to a horizontal position over the chair, as illustrated in FIG. 6, or may be rotated clockwise 270° to a position parallel with the vertical column 140. When in this position it can be placed in storage by rotating the vertical column 140 to face in the rearward direction.

Chains 146 attached to the outrigger 144 can be secured to a lifter sling 145 by clips (not shown) for lifting a patient. Such a mechanism is illustrated in U.S. Pat. No. 3,137,011 by the same inventor as the device disclosed herein.

To operate the lifting mechanism, the outrigger 144 is swung over from the stored position into a position across the body of the patient or the seat cushion 17. A stop in the horizontal arm 142 holds the outrigger arm 144 in this position. The transporting device is then raised to its highest position and the lifting sling 148 positioned around the patient. The device is then lowered to its lowest position, lifting the patient in the sling from the seat 17. A bedpan or other device may then be placed beneath the patient and the seat raised until the patient is positioned on the bedpan. To remove the patient from the bedpan the procedure is reversed.

The lifting mechanism may be completely removed by simply lifting the vertical pipe or tube 140 out of the inner tube 15, if desired. Alternatively, the lifting mechanism can be stored by simply lifting the vertical tube 140 and rotating it 180° until the horizontal arm 42 is facing backwards adjacent to the back rest 18. The lifting mechanism is retained in this position by a pin 150 secured in the inner tube 15 and engaging slots 152 on opposite sides of the vertical column 140. Thus, the vertical column or tube 140 is retained in one or two positions by simply lifting and turning. To store the device, the outrigger 144 is rotated clockwise 270° to a vertical position parallel with the vertical tube 140. The entire lifting mechanism is then rotated to face backwards by simply lifting and turning until the pin 150 drops to the slot 152 on either side of the vertical tube 140. Thus, the lifting mechanism may be placed easily in a stored position. The lifting mechanism illustrated in FIGS. 1, 6, 7 and 8 may be used with or without the arm rest, if desired. In FIG. 1 the vertical column 140 passes through a hole in the left arm rest 122. In FIG. 6 the device is illustrated without the arm rest for clarity or as a variation, if desired.

Thus, there has been disclosed a lifting and transporting mechanism with a cantilevered construction which is readily convertible from a chair to a stretcher and is simple and easy to operate. The lifting and transporting device can be operated in a number of different modes. It can be operated as an automatic device convertible from a chair to a stretcher by disengaging the plunger 42 and engaging the plunger 100 to provide a fixed length connecting rod 88 to operate the device. It can be operated in a manual mode by disengaging plunger 100 and plunger 42 and operating the back rest and foot rest manually by means of handle 40. In addition to these modes, it can be operated simply as a stretcher or a chair which can be raised and lowered. This function is performed by engaging the plunger 42 in the lowest of indexing holes 38 in the indexing plate 32. With the plunger 100 disengaged the device may now be raised and lowered as a seat. In the stretcher mode the device may be rotated to the flat position with the plunger 42 engaged in the uppermost of indexing holes 38 in the indexing plate 32. Now with the plunger 100 disengaged, the device can be raised and lowered as a stretcher.

Obviously, many modifications and variations of the present invention are possible in light of the above teachings. It is therefore to be understood that the full scope of the invention is not limited to the details desclosed herein but may be practiced otherwise than as specifically described.

What is claimed is:

1. A convertible lifting and transporting device comprising:
   a U-shaped base having the ends joined by one side;
   a pair of vertical supports mounted on said one side;
   a horizontal frame attached to said vertical supports having a seat;
   a back rest rotatably mounted on one side of said seat;
   a leg rest rotatably mounted on the other side of said seat;
   said vertical supports including means for raising and lowering said horizontal frame, back rest and leg rest;
   rotatable means rotatably joining the back rest to the leg rest whereby said back and leg rests may be simultaneously rotated from a substantially vertical position to a horizontal position parallel with said seat to form a stretcher; and
   lock means for locking said lifting and transporting device in the upright or flat position.

2. The device according to claim 1 wherein said rotatable means comprises:
   a rotatable articulated parallelogram linkage including the seat frame as a fixed side and having two vertical members rotatably hinged to a horizontal member; and
   said vertical members being securely attached to and rotatable with said back and leg rests respectively.

3. The device according to claim 1 including:
   a screw and nut combination coaxially mounted in one of said vertical supports; and
   crank means for operating said screw whereby said lifting and transporting device may be raised and lowered.

4. The device according to claim 3 wherein said supports comprise a pair of telescoping tubes, the inside tube being attached to the frame and the outside tube being attached to the seat and raising and lowering when said crank is operated.

5. The device according to claim 2 wherein said locking means comprises:
   an indexing plate attached to said lifting and transporting device for simultaneous rotation with said back rest;
   a plurality of indexing holes in said indexing plate; and
   a plunger adapted to engage the selected hole in said indexing plate to lock said lifting device in a predetermined position.

6. The device according to claim 5 wherein said indexing plate is attached to said back rest and forms therewith one of the vertical members of the articulated parallelogram.

7. The device according to claim 2 including:
   an extension attached to and rotatable with said back and leg rests;
   a connecting rod pivotally attached to said base frame at one end;
   pivot means pivotally connecting said extension to said connecting rod;
   whereby when said lifting and transporting device is raised it automatically converts from a chair to a stretcher and when it is lowered it automatically converts from a stretcher to a chair.

8. The device according to claim 7 wherein said extension includes:
   an indexing plate;
   a plurality of holes in said indexing plate; and
   a plunger for selectively engaging the holes in said indexing plate whereby said lifting and transporting device may be locked in a predetermined position.

9. The device according to claim 8 including:
   holding means for holding said plunger in a disengaged position whereby said lifting and transporting device may be operated in an automatic converting mode.

10. The device according to claim 9 wherein said connecting rod comprises:
   a plurality of telescoping rods;
   second plunger means for locking said telescoping rods together at a fixed length for the automatic converting mode; and
   detent means for holding said second plunger means in a disengaged position whereby the length of said telescoping rods may vary during a manual converting mode.

11. The device according to claim 1 including:
   a pair of arm rests attached to said seat frame;
   folding means for folding the arm rest attached to the seat frame on the side opposite the supports whereby when a patient is being transferred to said lifting and transporting device, said arm may be folded out of the way.

12. The device according to claim 1 including:
   lifting means for lifting a patient off said device said lifting means comprising:
   a rotatable outrigger rotatable from a stored position to a position over the seat portion of said device;
   a sling detachably secured to said outrigger which may be placed around the patient with the device raised to its highest position;
   whereby when said device is lowered, the patient is supported by said sling.

13. The device according to claim 12 wherein said outrigger comprises:
   a first vertical column rotatably attached to said base;
   a horizontal arm on said vertical column rotatable therewith from a rearward facing position to a forward facing position;
   a rotatable arm attached to said horizontal arm;
   said rotatable arm being rotatable from a vertical downward position to a horizontal position; and
   limit stop means for stopping said rotatable arm in a horizontal position.

14. The device according to claim 13 wherein said vertical column comprises:
   a post removably supported by one of said vertical supports.

15. The device according to claim 14 including:
   stop means for stopping said column in a rearward or forward facing position.

16. The device according to claim 15 wherein said stop means comprises:
   a fixed pin in said vertical support;
   one or more slots in said post fitting over said pin to prevent rotation whereby said post may be lifted and rotated to a stored position and locked by dropping the slot over the pin.

17. The device according to claim 14 wherein:

said vertical supports comprise a pair of telescoping tubes;

said post sliding down inside the inside tube of said telescoping members;

whereby said outrigger may be removed, sliding the vertical column out of the vertical telescoping tube.

* * * * *